US006406608B1

(12) United States Patent
Uzoh et al.

(10) Patent No.: US 6,406,608 B1
(45) **Date of Patent: *Jun. 18, 2002**

(54) APPARATUS TO MONITOR AND ADD PLATING SOLUTION TO PLATING BATHS AND CONTROLLING QUALITY OF DEPOSITED METAL

(75) Inventors: Cyprian Emeka Uzoh, Hopewell Junction; Wilma Jean Horkans, Ossining; Panayotis Constantinou Andricacos, Croton-on-Hudson, all of NY (US)

(73) Assignee: International Business Machines Corporation, Armonk, NY (US)

( * ) Notice: Subject to any disclaimer, the term of this patent is extended or adjusted under 35 U.S.C. 154(b) by 1 day.

This patent is subject to a terminal disclaimer.

(21) Appl. No.: 09/631,679

(22) Filed: Aug. 2, 2000

Related U.S. Application Data

(63) Continuation of application No. 08/975,756, filed on Nov. 21, 1997, now Pat. No. 6,113,769.

(51) Int. Cl.[7] ..... C25D 21/18; C25B 15/00

(52) U.S. Cl. ..... 205/101; 204/237; 204/238; 204/275.1; 204/276; 204/277

(58) Field of Search ..... 205/101; 204/237, 204/238, 275.1, 276, 277

(56) References Cited

U.S. PATENT DOCUMENTS 3,627,661 A * 12/1971 Gordon et al. ..... 204/474
3,649,509 A * 3/1972 Morawetz et al. ..... 204/474
4,092,242 A * 5/1978 Deane ..... 210/23
4,713,149 A 12/1987 Hoshino
4,781,806 A 11/1988 Tenace et al.
4,834,850 A * 5/1989 De Nora et al. ..... 204/109
5,104,496 A 4/1992 Dupree
5,192,418 A 3/1993 Hughes et al.
5,227,046 A * 7/1993 Murphy et al. ..... 205/252
5,308,464 A 5/1994 Murphy et al.
5,368,715 A * 11/1994 Hurley et al. ..... 205/82
5,437,777 A 8/1995 Kishi
5,858,196 A * 1/1999 Ikenaga ..... 205/82
6,113,769 A * 9/2000 Uzoh et al. ..... 205/101

* cited by examiner

*Primary Examiner*—Arun S. Phasge
(74) *Attorney, Agent, or Firm*—Connolly Bove Lodge & Hutz LLP; Joseph P. Abate

(57) ABSTRACT

An apparatus for monitoring and adding solution to a plating bath and controlling the quality of deposited metal. At least one monitor monitors at least one condition within a plating bath and produces at least one signal corresponding to the at least one condition. At least one controller receives the at least one signal produced by the at least one monitor, processes the at least one signal, determines whether an additional amount of at least one chemical should be added to the plating bath, and controls at least one valve for controlling flow of the additional amount of the at least one chemical. A pre-mix tank pre-mixes chemicals to be added to the tank. A plurality of holding tanks holds chemicals and supplies the chemicals to the pre-mix tank. At least one valve is arranged between each holding tank and the pre-mix tank. At least one valve is also arranged between the pre-mix tank and the plating bath.

41 Claims, 1 Drawing Sheet

APPARATUS TO MONITOR AND ADD PLATING SOLUTION TO PLATING BATHS AND CONTROLLING QUALITY OF DEPOSITED METAL

This application is a continuation of Ser. No. 08/975,756 filed Nov. 21, 1997 now U.S. Pat. No. 6,113,769.

FIELD OF THE INVENTION

The present invention relates to plating baths or plating metal onto substrates. More particularly, she present invention relates to an apparatus and method for monitoring and adjusting conditions within plating baths and for plating metal onto substrates.

BACKGROUND OF THE INVENTION

Baths or reservoirs for holding a plating bath that includes at least one material, such as a metal, to be, plated on a substrate are used in a wide variety of applications. For example, plating baths are commonly used in microelectronic device manufacturing. According to one example, baths are utilized for electroplating and for electroless plating on substrates.

Composition of plating baths and conditions within the plating bath must be carefully controlled to produce deposition of a desired quality of desired metal(s) on a substrate. Plating rate, uniformity, and deposit quality may be affected by a variety of factors. For example, one parameter that may affect rate, uniformity, and deposit quality of plating is concentration of chemicals in the plating bath as well as uniform distribution of the chemicals during production.

Along these lines, it is desirable to maintain the plating bath solution as close as possible to ideal conditions for plating. However, as the plating process proceeds, the characteristics of the solution, such as concentration and uniformity of chemicals, change as chemicals are used up in the plating process and components of the plating bath, such as surfactants, break down chemically and various byproducts build up.

According to standard practice, materials making up the plating bath typically are added individually directly to the bath. Once material is added to the bath, a period of time must pass before the material will be uniformly distributed throughout the plating bath. As can be appreciated, differential concentration of a material in the plating bath can with time result in non-uniform amounts plating distribution and variable deposit quality. For example, the quality of films plated relatively later may be interior to the quality of earlier plated films.

SUMMARY OF THE INVENTION

An object of the present invention is to provide a system for pre-mixing chemicals to be added to a plating bath.

Another object of the present invention is to provide an apparatus and method for helping to ensure uniform distribution of materials in a plating bath.

An additional object of the present invention is to provide a method and apparatus for helping to ensure uniform plating of a material on a substrate.

A further object of the present invention is to provide an apparatus and method for monitoring a plating bath and adding materials as required.

Yet another object of the present invention is to provide an apparatus and method for controlling the quality of deposited metal.

Still another object of the present invention is to provide an apparatus and method for recycling and recovering plating solutions in situ.

In accordance with these and other objects and advantages, the aspects of the present invention provide an apparatus for monitoring and adding materials to a plating bath. The apparatus includes at least one monitor for monitoring conditions within the plating bath and producing at least one signal corresponding to the monitored conditions. At least one controller receives the at least one signal produced by the at least one monitor, processes the at least one signal, determines whether an additional amount of at least one chemical should be added to the plating bath, and controls at least one valve for controlling flow of the at least one chemical. A pre-mix tank is provided for pre-mixing chemicals to be added to the plating bath. A plurality of holding tanks hold chemicals and supply chemicals to the pre-mix tank. A valve is provided between each of the holding tanks and the pre-mix tank, as well as between the pre-mix tank and the plating bath.

Aspects of the present invention also provide a plating bath system including a plating bath reservoir for holding a plating bath and plating at least one material from the plating bath onto at least one substrate. At least one monitor monitors conditions within the plating bath and produces at least one signal corresponding to the monitored conditions. At least one controller receives the at least one signal produced by the at east one monitor, processes the at least one signal, determines whether an additional amount of at least one chemical should be added to the plating bath, and controls at least one valve for controlling flow for the addition of the additional amount of the at least one chemical. A pre-mix tank is provided for pre-mixing chemicals to be added to the plating bath. A plurality of holding tanks holds chemicals and supplies the chemicals to the pre-mix tank. At least one valve is provided between each of the holding tanks and the pre-mix tank, as well as between the pre-mix tank and the plating bath. The method includes introducing at least one treatment chemical into each holding tank. Selected ones of the treatment chemicals are introduced into the pre-mix chamber. The selected ones of the treatment chemicals are introduced into the plating bath reservoir to act as a plating bath after passage of a period of time sufficient for the selected ones of the treatment chemicals to mix in the pre-mix chamber. At least one substrate to be treated is introduced into the plating bath. At least one condition within the plating bath is monitored by the at least one monitor. The at least one monitored condition is analyzed to determine whether the plating bath requires addition of at least one treatment chemical. The valves of the plating bath system are controlled with the processor to introduce a required additional amount at least one treatment chemical into the pre-mix chamber from at least one of the holding tanks. The additional amount of at least one treatment chemical is introduced into the plating bath reservoir after passage of a period of time sufficient for the added treatment chemicals to mix.

Furthermore, aspects of the present invention provide a method for controlling a plating bath solution in a plating bath system that includes a plating bath reservoir, at least one monitor, at least one controller, a pre-mix tank, a plurality to holding tanks, at least one valve between each of the holding tanks and the pre-mix chamber and at least one valve between the pre-mix tank and the plating bath reservoir. The method includes monitoring at least one condition within the plating bath with the at least one monitor. The at least one monitored condition is analyzed to determine whether the plating bath requires addition of at least one treatment chemical. The valves in the plating bath system are controlled for introducing the required additional amount at lease one treatment chemical into the pre-mix tank from at least one of the holding tanks. The additional amount of at least one treatment chemical is introduced into the plating bath reservoir after passage of a period of time sufficient for the additional at least one treatment chemical to mix.

Still other objects and advantages of the present invention will become readily apparent by those skilled in the art from the following detailed description, wherein it is shown and described only the preferred embodiments of the invention, simply by way of illustration of the best mode contemplated of carrying out the invention. As will be realized, the invention is capable of other and different embodiments, and its several details are capable of modifications in various obvious respects, without departing from the invention. Accordingly, the drawings and description are to be regarded as illustrative in nature and not as restrictive.

BRIEF DESCRIPTION OF THE DRAWINGS

The above-mentioned objects and advantages of the present invention will be more clearly understood when considered in conjunction with the accompanying drawings, in which.

DETAILED DESCRIPTION OF THE INVENTION

Figure 1:
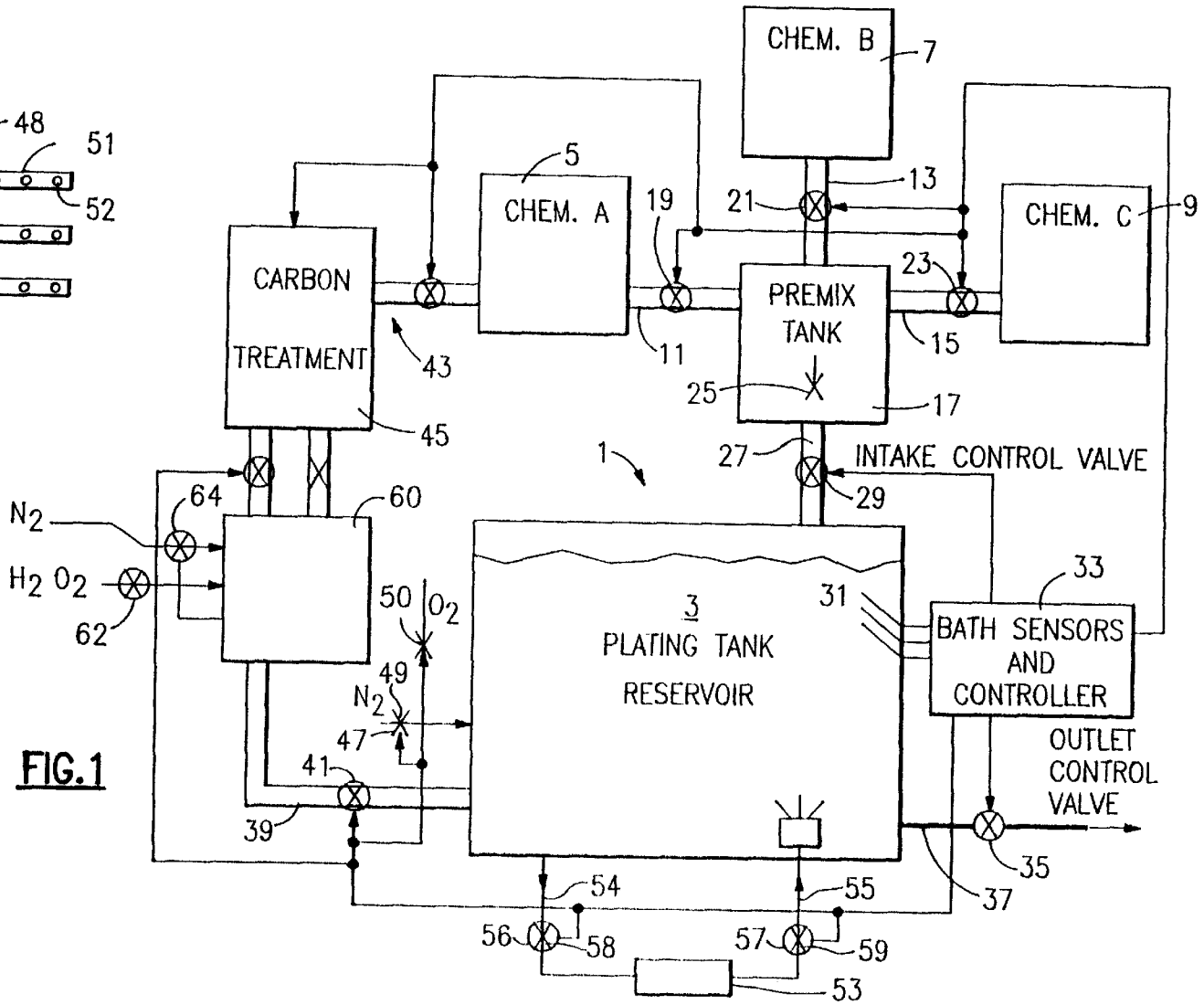
FIG. 1 represents a schematic view of an embodiment of a plating bath system according to the present invention.

As stated above, the present invention provides a plating bath system that includes apparatus to monitor and add materials to a plating bath. FIG. 1 provides a schematic view of a plating bath system according to one embodiment of the present invention. Typically, a plating bath system includes a planing tank or reservoir 1. The plating reservoir 1 typically contains the plating bath or solution 3.

Typically, substrates (not shown) are introduced into the plating bath 3 or into a plating cell connected to the plating reservoir by an inlet and an outlet path to permit a metal from the plating bath to be deposited upon the substrates. As stated above, the metal may be deposited upon the substrate through electroplating or electroless plating. One example of metal that may be plated on a substrate is copper. Examples of other metals that may be plated include gold, nickel, platinum, rhodium, cobalt, palladium, silver, chromium, zinc, tin, lead, tungsten, and/or alloys that include one or more or these metals. Alloys may also include other elements. Such alloys could include CoP, NiP, WCoP, and SnCoP. Further examples, include SnPb solders and other solders, magnetic alloys, and/or Permalloy.

Examples of substrates that typically are plated in such processes are electronic packages or silicon wafers. These substrates may or may not have additional materials deposited upon them.

The plating bath may include at least one metal to be plated on the substrate. The plating bath may also include other chemicals such as surfactants, catalysts, buffers, among others.

According to the present invention, chemicals making up the plating bath are stored in tanks. Each tank may include one or more chemicals. A plating bath system according to the present invention includes at least two such tanks. The embodiment shown in FIG. 1 includes three tanks 5, 7, and 9. The chemicals included in the holding tanks are not necessarily pure. They could be mixed with one or more other chemicals.

Each holding tank is connected, either directly, or by a conduit 11, 13, 15 in the embodiment shown in FIG. 1, to pre-mix tank 17. Between each holding tank and the pre-mix tank is arranged a valve, 19, 21, 23 in the embodiment shown in FIG. 1. The valves 19, 21, and 23 control flow between the holding tanks and the pre-mix tank. The valves may be controlled by at least one controller described below in greater detail.

As stated above, chemicals making up the plating bath preferably are introduced into the pre-mix tank prior to introduction into the plating tank so as to help ensure that the chemicals contained in the holding tanks are at least partially and, preferably, thoroughly mixed prior to introduction into the plating bath reservoir. The chemicals may mix simply by sitting in the pre-mix tank, through diffusion. Alternatively, the pre-mix tank 17 may include at least one agitator 25 for facilitating the mixing of the chemicals in the pre-mix tank.

After passage of a time sufficient to mix the chemicals in the pre-mix tank, the chemicals may be moved from the pre-mix tank into the plating bath reservoir. The pre-mix tank may be connected directly to the plating bath reservoir or through conduit 27. In any case, an intake control valve 29 preferably controls flow of chemicals from the pre-mix tank to the plating bath reservoir. As with the valves 19, 21, 23, the intake control valve 29 may be controlled by at least one controller as described below in greater detail.

The present invention also preferably includes at least one sensor or monitor 31 for sensing or monitoring at least one condition within he plating bath. The at least one sensor may include a variety of different sensors. Among the sensors that may be included in the plating bath according to the present invention are thermocouples to measure bath temperature, pH meters, calorimeters, specific ion electrodes, high pressure liquid chromatograph, oxygen sensors to monitor dissolved and/or non-dissolved oxygen content, $N_2$ sensors, and electrochemical sensors that may perform cyclic voltammetry, polarography, additive sensors or stripping analysis. Among the conditions determined by these sensors are the concentrations or various species that are present in the plating bath, such as the hydrogen ion, in other words, the acidity, metal ions, organic addition agents, or inorganic ions, such as copper, $SO_4$=and/or chloride ions.

Regardless of what sensor(s) is utilized and what condition(s) is sensed within the bath, preferably, the sensor (s) can detect depletion, degradation, and/or chemical breakdown, among other conditions within the plating bath that indicate that additional amounts of chemical(s) need to be added to the bath. After sensing the condition(s), the sensor(s) produces at least one signal corresponding to the at least one sensed condition. The at least one sensor transmits the a least one signal to at least one controller 33.

The at least one controller 33 receives the at least one signal, processes and analyzes the at least one signal to determine the at least one condition within the plating bath. The at least one controller then compares the at least one value sensed by the at least one sensor and analyzed by the at least one controller with at least one preferred value for the at least one variable sensed by the at least one sensor. If the value of the at least one sensed variable differs from the at least one control value by more than a predetermined amount, the at least one controller will generate at least one signal and send it to at least one of valves 19, 21, and 23 to permit an additional amount of at least one chemical contained within at least one of holding tanks 5, 7, and 9 to flow into pre-mix tank 17.

At least one controller 33 also generates at least one signal and transmits it to intake control valve 29 that controls flow of chemicals between the pre-mix tank 17 and the plating tank reservoir 1.

The present invention may also include at least one plating bath drain valve 35 controlling draining of plating bath from the plating bath reservoir 1. The at least one drain valve 35 may be connected to plating bath reservoir 1 with at least one drain conduit 37. Opening and closing of the at least one plating bath drain valve 35 may be controlled by the as least one controller 33. Accordingly, the at least one controller 33 may produce and transmit to the at least one plating bath drain valve 35 at least one signal for opening and closing the at least one plating bath drain valve 35. Each of smaller holding tanks 5, 7, 9, 25, and 45 may includes a drainage outlet and inlet for rinsing the tank. Deionized water is an example of a material that could be used for such a rinse.

Also connected to plating bath reservoir 1 may be at least one plating bath recycle conduit 39. The at least one plating bath recycle conduit 39 permits at least a portion of plating bath 3 to be diverted from the plating bath to the pre-mix tank 17. Control of plating bath through the at least one plating bath recycle conduit 39 may be controlled by at least one plating bath recycle valve 41. At least one second valve 43 may be arranged in the at least one plating bath recycle conduit 39 for controlling flow of recycle plating bath from conduit 39 into tank 5 and/or pre-mix tank 17. Although FIG. 1 illustrates the recycle conduit emptying into tank 5, the recycle material may enter directly into the pre-mix tank.

The present invention may also include an additive digestion tank. An additive digestion tank 60 may be located in recycle lines 39 to treat recycled plating bath medium. In the additive digestion tank, materials may be introduced into the recycled plating bath to accomplish various objectives. For example, material may be introduced to enhance to breakup of certain materials present in the recycled plating bath. One example of such a material is $H_2O_2$. According to such an embodiment, $H_2O_2$ may be injected into the recycled plating bath to enhance break down of organic additives. Also, $N_2$ may be introduced into an additive digestion tank at the end of an additive breakup process to reduce the amount of dissolved $O_2$ in the solution resulting from the digestion prior to advancing the digested solution to a filter as discussed below.

Accordingly, the apparatus of the present invention may also include a source of $H_2O_2$ and a source of $N_2$ to introducing these materials into the digestion tank. The apparatus may include valves 62 and 64 for controlling flow of these materials. The apparatus may also include connections between the controller and the valves for controlling flow of these materials.

Opening and closing of the at least one plating bath recycle valve 41 may be controlled by the at least one controller 33. Accordingly, the at least one controller 33 may generate and transmit at least one signal to at least one plating bath recycle valve 41 to control opening and closing of the valve and, thereby, flow of plating bath through the at least one plating bath recycle conduit 39. As with plating bath recycle valve 41, opening and closing of recycle valve 43 may be controlled by the at least one controller 33 in a manner similar to the manner that the controller controls recycle valve 41.

Also arranged in the at least one plating bath recycle conduit 39 may be at least one filter 45. The at least one filter may e out impurities, spent chemicals, degraded or broken-down chemicals, and other undesirable materials from plating bath recycled through plating bath recycle conduit 39. One example of a fitter that may be used in plating bath recycle conduit 39 is a carbon filter. One example of a carbon filter that could be utilized adsorbs organic and inorganic components from the plating bath. Another example of a filter that could be utilized is a particulate filter. One example of a preferred particulate filter is the DARCO 60, available from American Norit Corp. of Atlanta, Ga., particulate carbon filter packed in a cartridge housing.

After carbon filtration, the solution may be passed through a filter to filter out particles. Such a filter could block passage of material having dimensions from about 1.0. $\mu$m to about 0.05 $\mu$m. After any filtration, the recycled solution may be passed to the tank 5.

As shown in FIG. 1, the present invention may also include at least one source of gas 47 for introducing at least one gas into the plating bath 3. Control of gas flowing into the plating bath may be controlled by at least one gas flow control valve 49 and/or 50. As with the other valves in the system, opening and closing of the at least one gas flow control valve 49 may be controlled by the at least one controller 33.

The at least one gas may be introduced into the plating bath to control the oxygen content of the plating bath and thereby to enhance plating bath life and quality of the layer of material plated on a substrate introduced into the plating bath. To reduce additive degradation in the plating bath, during non-production periods, $N_2$ gas may be introduced into the plating bath tank 3 through a gas manifold 48. The amount of $N_2$ introduced into the plating bath may be sufficient to displace as much $O_2$ as possible. This is because low $O_2$ content of the plating bath may reduce additive consumption at the anode.

Figure 2:
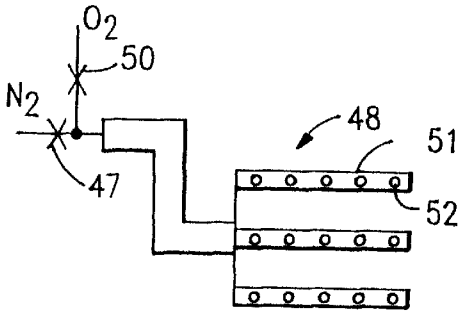
FIG. 2 represents a close-up view of an embodiment of a gas manifold for introducing gas into the plating bath.

The gas manifold 48 may be located at the bottom of the tank, as shown in FIG. 2. The gas manifold includes at least one gas supply. The embodiment shown in FIG. 2 includes two gas supplies 47 and 50 for $N_2$ and $O_2$, respectively. A valve may control the introduction of gas(es) into the plating bath reservoir. The controller may be connected to the valves to control opening and closing of the valves.

The gas supply or supplies may be connected to at least one element 51 for introducing the at least one gas into the plating bath as bubbles. The embodiment shown in FIG. 2 includes three elongated elements 51 that include a plurality of small passages 52 for introducing gas into the plating bath. The gas introduction manifold may be located anywhere in the plating bath tank or reservoir as long as the gas is introduced under the surface of the plating bath. Preferably, the gas introduction manifold is located at the bottom of the plating bath reservoir.

The at least one gas that may be introduced into the plating bath may include a variety of gasses that may include nitrogen, oxygen, and/or an inert gas. The at least one gas may be introduced into the plating bath by bubbling. The gas may be bubbled into the plating bath through the gas manifold 48.

The characteristics of the gas flow may vary, depending upon the application. According to one example, $N_2$ is introduced into the bath at a rate as high as about 5 sscm/L. When the $O_2$ concentration in the plating bath falls below about 2 ppm, the controller may reduce the flow rate of $N_2$ to a rate in a range of from about 0.2 to about 2.0 sccm/L.

By controlling the ratio of $N_2$ to $O_2$ injected into the plating bath, the concentration of $O_2$ dissolved in the solution may be used to control how much of the substrate is etched off prior to initiating plating.

In plating substrates with a thin seedlayer, for example, below about 20 nm, the $O_2$ concentration the bath preferably is maintained at a level. For example, the $O_2$ concentration may be maintained at a level below about 5 ppm This may help to minimize seedlayer loss on the substrate before the onset of plating. For workpieces that include a thicker seedlayer, such as about 300 nm, a higher $O_2$ level may be tolerated to adequately etch the seedlayer prior to initiating plating.

The apparatus of the present invention may also include a plating tank or reservoir recirculation pump 53 to assist in maintaining the plating bath in a mixed state. Recirculation pump 53 may be connected to the plating tank by conduits 54 and 55. The connections between the recirculation pump and the plating tank may provide an inlet and an outlet. Regardless of how it is connected to the plating tank, two valves 56 and 57 may be arranged in the conduits. The valves may be opened or closed, depending upon whether it is desired to have the plating bath mixed at any particular time. The valves may be controlled by the controller as indicated by connections 58 and 59. The outlet of the pump into the tank may be equipped with an eductor. The eductor may help to prevent formation of stagnant zone(s) within the tank.

The at least one sensor 31 may monitor for the presence of a variety of species. For example, the at least one sensor 31 may monitor for the presence of at least one metal, inorganic additive, and/or organic additive. According to one example, the at least one sensor detects the presence of at least one electroactive species and/or at least one byproduct of at least one electroactive species.

The present invention may also include at least one monitor or sensor for monitoring at least one condition with the recycle portions of the plating bath The at least one sensor monitoring at least one condition within the recycle portions of the plating bath may be selected from the same group of sensors as described above for monitoring conditions within the plating bath. The at least one sensor monitoring the recycle portion of the plating bath may also detect the presence of absence of at materials monitored by the at least one sensor monitoring conditions within the plating bath.

Where the plating bath system of the present invention is described as including at least one of a component described above, any number of such components could be included. One skilled in the art would know how to modify the system to include more that one component and when such modifications would be necessary once aware of the present disclosure without undue experimentation.

The present invention also includes a method for plating metals on a substrate in a plating bath system. The plating bath system may be a plating bath system such as described above. According to the method, at least one chemical may be introduced into each of holding tanks 5, 7, and 9. To form the plating bath or solution, selected ones of the chemicals may be introduced into the pre-mix chamber 17 from holding tanks 5, 7, and/or 9 by opening selected ones of valves 19, 21, and 23 between holding tanks 5, 7, and 9 and plating bath 17. The at least one controller may control opening and closing of the valves.

Of course, the present invention may be utilized in any system that includes two or more chemicals or species to form a plating bath contained in two or more holding tanks. The example shown in FIG. 1 includes three chemicals in three holding tanks simply for the purposes of example.

As described herein, at least a portion of the plating bath may be recycled. Chemical(s) from at least one of the holding tanks may be introduced into the pre-mix tank along with the recycled plating bath. Therefore, in some instances, only one chemical from only one holding tank may be introduced into pre-mix tank to mix with recycled plating bath, rather than introducing a plurality of chemicals from the holding tanks to form the plating bath.

Once in pre-mix tank, the chemicals, including chemicals from the holding tanks and/or recycled plating bath, may be retained within the pre-mix tank for a time sufficient for the chemicals to become at least partially mixed. As described above, the pre-mix tank may have an agitator 25 for facilitating the mixing of the chemicals making up the plating bath. Once a sufficient time has passed for the chemicals making up the plating bath to mix, the intake control valve 29 may open, permitting the chemicals within the pre-mix tank to flow into the plating bath reservoir 1. As described above, the valve may be controlled by the at least one controller.

At least one substrate on which metals are to be plated may be introduced into the plating bath. As the plating reaction takes place, at least one condition within the plating bath may be monitored by at least one sensor 31. As discussed above, the at least one sensor may produce at least one signal and transmit the signal to the at least one controller 33. The at least one controller 33 analyzes the at least one signal and determines whether additional chemical (s) need to be added to the plating bath.

If the at least one controller 33 determines that additional chemical(s) need to be added to the plating bath, the at least one controller 33 may send at least one signal to at least one of the valves 19, 21, 23 between holding tanks 5, 7, 9, and re-mix tank 17 to permit at least one material to flow from at least one holding tank 5, 7, or 9 into pre-mix tank 17. Before, during, or after introduction of at least one chemical from holding tanks 5, 7, and 9, the at least one controller 33 may also cause the recycling of at least a portion of plating bath 3 through a recycle conduit 39 into premix tank 17.

Chemical(s) from the holding tank(s) and/or recycle plating bath may be retained within pre-mix tank for a time sufficient for the chemicals to at least partially mix. The mixing of the chemicals may be facilitated by agitator 25. After passage of a time sufficient for the chemicals in the pre-mix tank to at least partially mix, the at least one controller may open control valve 29 to permit flow of chemical(s) from the pre-mix tank into the plating bath reservoir to mix with the existing plating bath. Addition of additional chemical(s) from the holding tank(s) and/or recycled plating fluid may continue throughout the plating process.

As stated above, the method of the present invention may also include introducing at least one gas into the plating bath as well as monitoring and filtering the recycled portion of the plating bath.

The foregoing description of the invention illustrates and describes the present invention. Additionally, the disclosure shows and describes only the preferred embodiments of the invention, but as aforementioned, it is to be understood that the invention is capable of use in various other combinations, modifications, and environments and is capable of changes or modifications within the scope of the inventive concept as expressed herein, commensurate with the above teachings, and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

We claim:

1. An apparatus for monitoring and adding solution to a plating bath, said apparatus comprising:

at least one monitor to monitor at least one condition within the plating bath and producing at least one signal corresponding to said at least one monitored condition;

at least one controller for receiving said at least one signal produced by said at least one monitor, processing said at least one signal, determining whether an additional amount of at least one chemical should be added to the plating bath, and controlling at least one valves for controlling flow of said additional amount of said at least one chemical;

a premix tank for premixing chemicals to be added to the plating bath;

a plurality of holding tanks for holding chemicals and supplying the chemicals to the premix tank;

at least one valve between each of said holding tanks and said premix tank;

at least one valve between said premix tank and the plating bath;

a conduit connecting the plating bath to said premix tank for recycling at least a portion of the plating bath to said premix tank during plating and returning at least a portion of the recycled portion to the plating bath; and at least one treatment element for treating the recycled portion by removing undesirable materials including spent, degraded, and broken-down chemicals prior to reintroduction into the plating bath.

2. The apparatus according to claim 1, wherein the at least one treatment element comprises at least one filter arranged in said conduit between said premix tank and said plating bath for filtering chemically broken down chemicals in said recycled portion of the plating bath.

3. The apparatus according to claim 2, wherein said at least one filter is a carbon filter for adsorbing organic and/or inorganic components from the recycled portion.

4. The apparatus according to claim 1, wherein the at least one monitor is selected from the group consisting of high pressure liquid chromatograph, cyclic voltmeter, stripping analyzer, oxygen sensor, and temperature sensor.

5. The apparatus according to claim 1, further comprising:

a source of at least one gas for bubbling gas into the plating bath solution.

6. The apparatus according to claim 1, wherein the at least one gas is selected from the group consisting of nitrogen, oxygen and inert gases.

7. The apparatus according to claim 1, wherein the at least one monitor monitors at least one material selected from the group consisting of metals, inorganic additives, and organic additives.

8. The apparatus according to claim 1, wherein the organic additives are selected from the group consisting of electroactive species and byproducts of electroactive species.

9. The apparatus according to claim 1, wherein the at least one recycling conduit continuously recycles at least a portion of the plating bath during plating.

10. The apparatus according to claim 1, further comprising:

at least one monitor for monitoring conditions within said recycled portion of said plating bath.

11. A plating bath system, comprising:

a plating bath reservoir for holding a plating bath and plating at least one metal from the plating bath on to a substrate;

at least one monitor to monitor conditions within the plating bath and producing signals corresponding to said monitored conditions;

a controller for receiving said signals produced by said at least one monitor, processing said signals, determining whether an additional amount of at least one chemical should be added to the plating bath, and controlling valves for controlling flow of said additional amount of said at least one chemical;

a premix tank for premixing chemicals to be added to the plating bath;

a plurality of holding tanks for holding chemicals and supplying the chemicals to the premix tank;

a valve between each of said holding tanks and said premix tank;

a valve between said premix tank and the plating bath;

a conduit connecting the plating bath to said premix tank for recycling at least a portion of the plating bath to said premix tank during plating and returning at least a portion of the recycled portion to the plating bath; and at least one treatment element for treating the recycled portion by removing undesirable materials including spent, degraded, and broken-down chemicals prior to reintroduction into the plating bath.

12. The plating bath system according to claim 11, wherein the at least one treatment element comprises at least one filter arranged in said conduit between said premix tank and said plating bath for filtering chemically broken down chemical in said recycled portion of the plating bath.

13. The plating bath system according to claim 12, wherein said at least one filter is a carbon filter for absorbing organic and/or inorganic components from the recycled portion.

14. The plating bath system according to claim 11, wherein the at least one monitor is selected from the group consisting of high pressure liquid chromatograph, cyclic voltmeter, stripping analyzer, oxygen sensor, and temperature sensor.

15. The plating bath system according to claim 11, further comprising:

a source of at least one gas for bubbling gas into the plating bath solution.

16. The plating bath system according to claim 11, wherein the at least one gas is selected from the group consisting of nitrogen, oxygen and inert gases.

17. The plating bath system according to claim 11, wherein the at least one monitor monitors at least one material selected from the group consisting of metals, inorganic additives, and organic additives.

18. The plating bath system according to claim 11, wherein the organic additives are selected from the group consisting of electroactive species and byproducts of electroactive species.

19. The plating bath system according to claim 11, wherein the at least one recycling conduit continuously recycles at least a portion of the plating bath during plating.

20. The plating bath system according to claim 11, further comprising:

at least one monitor for monitoring conditions within said recycled portion of said plating bath.

21. A method for plating at least one metal on a substrate in a plating bath system, the plating bath system including a plating bath reservoir, at least one monitor, a controller, a premix tank, a plurality of holding tanks, a valve between each of said holding tanks and said premix tank, a valve between said premix tank and the plating bath reservoir, a conduit connecting the plating bath to said premix tank for recycling at least a portion of the plating bath to said premix tank during plating and returning at least a portion of the recycled portion to the plating bath, and at least one treatment element for treating the recycled portion prior to reintroduction into the plating bath, the method comprising:

introducing a chemical into each holding tank;

introducing selected ones of said chemicals into the premix chamber;

introducing said selected ones of said chemicals into said plating bath reservoir to act as the plating bath after passage of a period of time sufficient for said selected ones of said chemicals to mix;

introducing at least one substrate on which at least one metal is to be plated into said plating bath reservoir;

monitoring conditions within said plating bath with the at least one monitor;

analyzing said monitored conditions to determine whether said plating bath requires addition of at least one chemical;

controlling said valves with said processor to introduce a required additional amount of at least one chemical into said premix tank from at least one of said holding tanks;

introducing said additional amount of said at least one chemical into said plating bath reservoir after passage of a period of time sufficient for said additional at least one chemical to mix;

recycling at least a portion of the plating bath from the plating bath reservoir to the premix tank during plating;

treating the recycled portion by removing undesirable materials including spent, degraded, and broken-down chemicals; and returning at least a portion of the recycled portion to the plating bath.

22. The method according to claim 21, wherein the at least one treatment element comprises at least one filter arranged in said conduit between said premix tank and said plating bath reservoir for filtering out chemically broken down chemicals in said recycled portion of the plating bath, said method further comprising:

filtering said recycled portion of the plating bath.

23. The method according to claim 21, wherein at least a portion of the plating bath is continuously recycled during plating.

24. The method according to claim 21, wherein said plating bath system further includes at least one source of gas for bubbling gas into the plating bath solution, said method further comprising the step of:

bubbling at least one gas into said plating bath solution.

25. The method according to claim 24, wherein said at least one gas is selected from the group consisting of nitrogen, oxygen and inert gases.

26. The method according to claim 21, wherein said at least one monitor is selected from the group consisting of high pressure liquid chromatograph, cyclic voltmeter, and stripping analyzer.

27. The method according to claim 21, wherein said at least one monitor monitors at least one material selected from the group consisting of metals, inorganic additives, and organic additives.

28. The method according to claim 21, wherein said plating bath system further includes at least one monitor for monitoring at least one condition of said recycled portion of said plating bath, said method further comprising the step of:

monitoring the at least one condition of said recycled portion of said plating bath.

29. A method for controlling a plating bath solution in a plating bath system, the plating bath system including a plating bath reservoir, at least one monitor, a controller, a premix tank, a plurality of holding tanks, a valve between each of said holding tanks and said premix tank, a valve between said premix tank and the plating bath reservoir, a conduit connecting the plating bath to said premix tank for recycling at least a portion of the plating bath to said premix tank during plating and returning at least a portion of the recycled portion to the plating bath, and at least one treatment element for treating the recycled portion prior to reintroduction into the plating bath, the method comprising:

monitoring conditions within said plating bath with the at least one monitor;

analyzing said monitored conditions to determine whether said plating bath requires addition of an amount of at least one chemical;

controlling said valves with said processor to introduce said required additional amount of said at least one chemical into said premix tank from at least one of said holding tanks;

introducing said additional amount of said at least one chemical into said plating bath reservoir after passage of a period of time sufficient for said additional treatment fluids to mix;

recycling at least a portion of the plating bath from the plating bath reservoir to the premix tank during plating;

treating the recycled portion by removing undesirable materials including spent, degraded, and broken-down chemicals; and returning at least a portion of the recycled portion to the plating bath.

30. The method according to claim 29, wherein at least a portion of the plating bath is continuously recycled during plating.

31. The method according to claim 29, wherein the at least one treatment element comprises at least one filter arranged in said conduit between said premix tank and said plating bath reservoir for filtering out chemically broken down chemicals in said recycled portion of the plating bath, said method further comprising:

filtering said recycled portion of the plating bath.

32. The method according to claim 31, wherein said plating bath system further includes at least one source of gas for bubbling gas into the plating bath solution, said method further comprising the step of:

bubbling at least one gas into said plating bath solution.

33. The method according to claim 32, wherein said at least one gas is selected from the group consisting of nitrogen, oxygen and inert gases.

34. The method according to claim 29, wherein said at least one monitor is selected from the group consisting of high pressure liquid chromatograph, cyclic voltmeter, and stripping analyzer.

35. The method according to claim 29, wherein said at least one monitor monitors at least one material selected from the group consisting of metals, inorganic additives, and organic additives.

36. The method according to claim 29, wherein said plating bath system further includes at least one monitor for monitoring at least one condition of said recycled portion of said plating bath, said method further comprising the step of:

monitoring the at least one condition of said recycled portion of said plating bath.

37. A plating apparatus, comprising:

a plating reservoir for holding a plating bath from which at least one metal is to be plated onto a substrate;

a conduit draining at least a portion of the plating bath from the plating reservoir for recycling during plating and returning at least a portion of the recycled portion to the plating reservoir; and at least one treatment element connected to the conduit for treating the recycled portion of the plating bath by removing undesirable materials including spent, degraded, and broken-down chemicals prior to reintroduction into the plating reservoir.

38. The plating apparatus according to claim 37, wherein the at least one treatment element comprises at least one filter arranged in the conduit for filtering chemically broken down chemicals in the recycled portion of the plating bath.

39. The plating apparatus according to claim 38, wherein the at least one filter is a carbon filter for adsorbing organic and/or inorganic components from the recycled portion of the plating bath.

40. The plating apparatus according to claim 37, further comprising:

a source of at least one of $H_2O_2$ and $N_2$ for introducing at least one of $H_2O_2$ and $N_2$ into the recycled portion of the plating bath.

41. A method for plating at least one metal on a substrate in a plating bath system, the plating bath system including a plating bath reservoir for holding a plating bath from which at least one metal is to be plated onto a substrate, a conduit draining at least a portion of the plating bath from the plating bath reservoir for recycling during plating and returning at least a portion of the recycled portion to the plating bath reservoir, and at least one treatment element connected to the conduit for treating the recycled portion of the plating bath prior to reintroduction into the plating bath reservoir, the method comprising:

introducing the plating bath into the plating reservoir;

introducing at least one substrate on which at least one metal is to be plated into the plating bath reservoir;

recycling at least a portion of the plating bath from the plating bath reservoir during plating;

treating the recycled portion by removing undesirable materials including spent, degraded, and broken-down chemicals; and returning at least a portion of the recycled portion to the plating bath reservoir.

* * * * *